US005458728A

United States Patent [19]

Galchefski

[11] Patent Number: 5,458,728

[45] **Date of Patent: * Oct. 17, 1995**

[54] APPARATUS AND METHOD FOR APPLYING LABELS ONTO SMALL CYLINDRICAL ARTICLES WITH IMPROVED SEAM FORMATION BY RETARDED ARTICLE ROTATION

[76] Inventor: John Galchefski, 327 Highlark Dr., Larksville, Pa. 18704

[ * ] Notice: The portion of the term of this patent subsequent to Apr. 11, 2012 has been disclaimed.

[21] Appl. No.: 265,803

[22] Filed: Jun. 27, 1994

[51] Int. Cl.[6] ..... B65C 9/00

[52] U.S. Cl. ..... 156/566; 156/448; 156/458; 156/567; 198/381

[58] Field of Search ..... 156/566, 446, 156/447, 448, 449, 450, 456, 458, 567, 568, 571, DIG. 26; 198/381, 468.5, 472.1, 679, 690.1, 803.6, 805

[56] References Cited

U.S. PATENT DOCUMENTS

| | | | |
|---|---|---|---|
| 2,703,660 | 3/1955 | Von Hofe et al. | 156/521 |
| 3,235,433 | 2/1966 | Cvacho et al. | 156/229 |
| 3,565,724 | 2/1971 | Yamaguchui et al. | 156/354 |
| 3,577,293 | 5/1971 | Ritterhoff | 156/156 |
| 3,604,584 | 9/1971 | Shank, Jr. | 215/12 R |
| 3,659,394 | 5/1972 | Hartleib et al. | 53/33 |
| 3,765,991 | 10/1973 | Hoffmann | 156/521 |
| 3,834,963 | 9/1974 | Hoffman | 156/215 |
| 3,878,960 | 4/1975 | Jonsson et al. | 215/12 R |
| 4,108,709 | 8/1978 | Hoffmann | 156/446 |
| 4,108,710 | 8/1978 | Hoffmann | 156/450 |
| 4,108,711 | 8/1978 | Hoffmann | 156/497 |
| 4,124,433 | 11/1978 | Herdzina et al. | 156/456 |
| 4,207,832 | 6/1980 | Bowman et al. | 118/212 |
| 4,216,044 | 8/1980 | Herdzina et al. | 156/215 |
| 4,242,167 | 12/1980 | Hoffmann | 156/357 |
| 4,323,416 | 4/1982 | Malthouse et al. | 156/521 |
| 4,336,095 | 6/1982 | Hoffmann | 156/361 |
| 4,366,016 | 12/1982 | Golden, Jr. | 156/218 |
| 4,400,721 | 9/1983 | Hoffmann | 156/86 |
| 4,416,714 | 11/1983 | Hoffmann | 156/86 |
| 4,425,866 | 1/1984 | Hoffmann | 118/58 |
| 4,443,285 | 4/1984 | Roth et al. | 156/215 |
| 4,447,280 | 5/1984 | Malthouse | 156/85 |
| 4,496,409 | 1/1985 | Kontz | 156/85 |
| 4,500,386 | 2/1985 | Hoffman | 156/449 |
| 4,519,868 | 5/1985 | Hoffmann | 156/353 |
| 4,526,645 | 7/1985 | Malthouse et al. | 156/350 |
| 4,544,431 | 10/1985 | King | 156/256 |
| 4,545,832 | 10/1985 | Hoffmann | 156/86 |
| 4,552,608 | 11/1985 | Hoffmann et al. | 156/351 |
| 4,561,928 | 12/1985 | Malthouse | 156/497 |
| 4,574,020 | 3/1986 | Fosnaught | 156/80 |
| 4,604,154 | 8/1986 | Fosnaught | 156/264 |
| 4,629,528 | 12/1986 | Tanaka et al. | 156/354 |
| 4,632,721 | 12/1986 | Hoffmann et al. | 156/458 |
| 4,662,925 | 5/1987 | Thimons et al. | 65/104 |

(List continued on next page.)

FOREIGN PATENT DOCUMENTS

| | | |
|---|---|---|
| 1012906 | 6/1977 | Canada . |
| 1106653 | 3/1968 | United Kingdom . |

*Primary Examiner*—James J. Engel
*Attorney, Agent, or Firm*—Morgan & Finnegan

[57] ABSTRACT

An apparatus applies labels onto small cylindrical articles and includes a label transport drum that defines a central axis. Labels are supplied onto the surface of the drum and returned thereto. The drum rotates about its axis so that the label moves with the drum into an article wrapping position. Small cylindrical articles are tangentially delivered onto the drum surface and into rotative engagement with the label as the label moves into the article wrapping position for wrap around labelling so that the trailing edge of the label overlaps its leading edge forming a bond. The rotation of the article is retarded after wrapping for a period of time while the drum continues its rotation so that the article rests on the overlapping seam and applies pressure while allowing sufficient time for any solvent or adhesive applied thereon to react with the label material. Magnetic attractive forces can be applied onto a magnetically attractive article to enhance pressure applied on the seam.

39 Claims, 5 Drawing Sheets

U.S. PATENT DOCUMENTS

| | | | |
|---|---|---|---|
| 4,671,836 | 6/1987 | Fumei | 156/215 |
| 4,686,931 | 8/1987 | Difrank | 118/50 |
| 4,693,210 | 9/1987 | Difrank | 156/259 |
| 4,694,633 | 9/1987 | Fujio et al. | 53/49 |
| 4,704,173 | 11/1987 | Hoffman | 156/86 |
| 4,724,037 | 2/1988 | Olsen | 156/518 |
| 4,726,872 | 2/1988 | Olsen | 156/455 |
| 4,729,811 | 3/1988 | Difrank | 156/449 |
| 4,735,668 | 4/1988 | Hoffmann | 156/215 |
| 4,761,200 | 8/1988 | Szeremeta | 156/448 |
| 4,772,354 | 9/1988 | Olsen et al. | 156/578 |
| 4,781,785 | 11/1988 | Szeremeta | 156/448 |
| 4,832,774 | 5/1989 | Difrank et al. | 156/215 |
| 4,844,760 | 7/1989 | Dickey | 156/215 |
| 4,844,957 | 7/1989 | Hoffman | 428/34.7 |
| 4,923,557 | 5/1990 | Dickey | 156/86 |
| 4,931,122 | 6/1990 | Mitchell | 156/215 |
| 4,977,002 | 12/1990 | Hoffman | 428/34.7 |
| 4,984,413 | 1/1991 | Cosmo | 53/465 |
| 5,037,499 | 8/1991 | Bright et al. | 156/456 |
| 5,045,140 | 9/1991 | Dickey | 156/215 |
| 5,078,826 | 1/1992 | Rogall | 156/451 |
| 5,091,040 | 2/1992 | Otruba | 156/566 |
| 5,091,239 | 2/1992 | Przeworski et al. | 428/195 |
| 5,116,452 | 5/1992 | Eder | 156/566 |

APPARATUS AND METHOD FOR APPLYING LABELS ONTO SMALL CYLINDRICAL ARTICLES WITH IMPROVED SEAM FORMATION BY RETARDED ARTICLE ROTATION

This application is related to U.S. patent application Ser. No. 08/115,433, entitled "APPARATUS AND METHOD FOR APPLYING LABELS ONTO SMALL CYLINDRICAL ARTICLES AND WEB AND ADHESIVE DELIVERY MECHANISM", filed Sep. 1, 1993, the disclosure which is hereby incorporated by reference.

FIELD OF THE INVENTION

This invention relates to an apparatus and method for applying labels onto small cylindrical articles using wrap around labelling.

BACKGROUND OF THE INVENTION

In commonly assigned, copending patent application Ser. No. 08/115,433, labels are applied onto small cylindrical articles such as dry cell batteries. A label transport drum has a central, preferably horizontal axis, and is rotated about its axis. A label feed mechanism feeds the label to the surface of the drum and the label is retained to the drum surface as the drum rotates. Adhesive is placed onto the leading edge of the label and a solvent is applied onto the trailing edge of the label as the drum rotates and moves labels past respective adhesive and solvent application stations.

Small cylindrical articles, such as the dry cell batteries, are conveyed onto the drum and into rotative engagement with the label as the label moves into an article wrapping position. In one aspect of the disclosed invention, during article delivery, an attractive force is imparted against the article to aid in smooth, tangential delivery of tile article onto the label transport drum. If the articles are magnetically attractive dry cells, a magnet is spaced outward from the label transport drum on the article delivery mechanism for imparting magnetic forces on the article in a direction away from the label transport drum to aid in smooth, tangential delivery of articles onto the drum surface and into engagement with the label positioned at the article wrapping position.

The solvent-seal bond imparted by the trailing edge solvent seals the label in confining relation to the article after wrapping. The label can then be heat shrunk about the article.

It has been found that it would be desirable if pressure were applied onto the seam and then maintained for a brief period of time as the drum continued its rotation. This pressure dwell time, when pressure is applied onto the seam, would allow any solvent or other adhesive a greater amount of time to react with the label to provide a higher quality and stronger bond.

SUMMARY OF THE INVENTION

It is therefore an object of the present invention to apply a label onto a small cylindrical article by wrap around labeling while improving the bonding where the trailing and leading label edges overlap.

It is still another object of the present invention to form an improved seam between the overlapping trailing and leading edges of a label which is applied onto a cylindrical article.

In accordance with the present invention, an apparatus and method of the present invention applies labels onto small cylindrical articles while retarding rotation of the article after the article has been wrapped for a period of time while the drum continues its rotation so that the article preferably rests on the seam, thus applying pressure to the seam while allowing sufficient time for any solvent or adhesive applied thereon to react with the label material and form a higher quality, stronger bond.

The apparatus includes a label transport drum that defines a central axis. A label is applied onto the surface of the drum and the drum is rotated about its axis so that the label moves with the drum into an article wrapping position after having adhesive and solvent applied to respective leading and trailing edges at respective adhesive and solvent application stations. Small cylindrical articles are delivered into rotative engagement with the drum as the label moves into an article wrapping position for wrap around labelling so that the trailing edge overlaps the leading edge forming a bond.

In one aspect of the invention, the articles are magnetically attractive, and the means to prevent article rotation comprises a plurality of magnets that exert a magnetic biasing force on the article to prevent rotation of the article. A concave configured article receiving pocket is positioned on the surface of a pivotably mounted article receiving member, which receives an article after the article is wrapped. The magnets are positioned in the pocket for exerting an attractive biasing force to prevent article rotation. A pressure plate exerts pressure onto an article during label wrapping, and in one aspect of the invention, the pressure plate includes a spring biased follower pivotally mounted on the pressure plate for engaging the article as it is wrapped. The follower plate disengages from the article after the article is wrapped.

A profiled drum surface formed within the outer part of the drum surface is positioned before the article receiving pocket in the direction of drum rotation to ensure that the article smoothly reaches the article receiving pocket and moves therein without bouncing out of the pocket. The drum rotates approximately 40 degrees while the article is retarded in its rotation before discharge from the drum surface.

In one aspect of the invention, the article receiving member has a concave surface with two opposing, exposed edges to form the article receiving pocket. The concave surface is configured for receiving an article therein. A plurality of slots are formed on the surface of the drum and an article receiving member is pivotally mounted in each slot. The trailing edge of the label is positioned in a me, dial portion of the concave article receiving pocket and the article receiving member is pivoted backward so that the forward-most exposed edge is raised to lift the trailing edge of the label into engagement with a solvent applicator positioned at the solvent application station so as to wipe solvent onto the trailing edge of the label. An article discharge area is positioned after the pressure plate and includes a stripper for stripping the article from the pocket after the article has moved with the drum to the article discharge area.

In another aspect of the invention, the article receiving member is pivotally mounted within the slot by a rocker shaft. A cam is mounted stationery on the machine frame and a cam follower is mounted outward of the rocker shaft a predetermined amount and engages the cam at specified points in the drum's rotation so as to pivot the article receiving member a predetermined amount.

BRIEF DESCRIPTION OF THE DRAWINGS

The foregoing and other objects and advantages of the present invention will be appreciated more fully from the following description, with references to the accompanying drawings in which.

DETAILED DESCRIPTION OF THE PREFERRED EMBODIMENT

The present invention is an apparatus and method for applying a label onto a small cylindrical article such as a dry cell battery so as to form an improved seam. This improved seam formation is accomplished by retarding rotation of the article after wrapping for a period of time while the drum continues its rotation so that the article has pressure applied on the seam, while allowing sufficient dwell time for a solvent or adhesive applied thereon to react with the label material.

An article receiving pocket is positioned on the surface of the drum and receives the article after having been wrapped on a profiled drum surface positioned before the pocket. Magnets are positioned in the pocket for exerting an attractive biasing force on the article to retain the article in the pocket and overcome the tendency for the article to rotate. The attractive magnetic forces are also applied when the article is retained in the pocket, to place pressure on the seam. The pressure plate exerts pressure onto the article during label wrapping, and in one aspect of the invention, the pressure plate includes a spring biased follower pivotally mounted on the pressure plate for engaging the article as it is wrapped. The follower disengages from the article after the article is wrapped. While the article rotation is retarded, the drum rotates approximately forty degrees before the article is discharged from the drum surface.

For purposes of explanation a general description of the apparatus is set forth below, including details of the article retarding mechanism of the present invention. Greater details of other components of a machine that may be used with the present invention with some modifications can be found in the copending, related application patent application Ser. No. 08/115,433, entitled "Apparatus and Method for Applying Labels Onto Small Cylindrical Articles and Web and Adhesive Delivery Mechanism," filed Sep. 1, 1993, the disclosure of which is hereby incorporated by reference.

Figures 1, 1A:
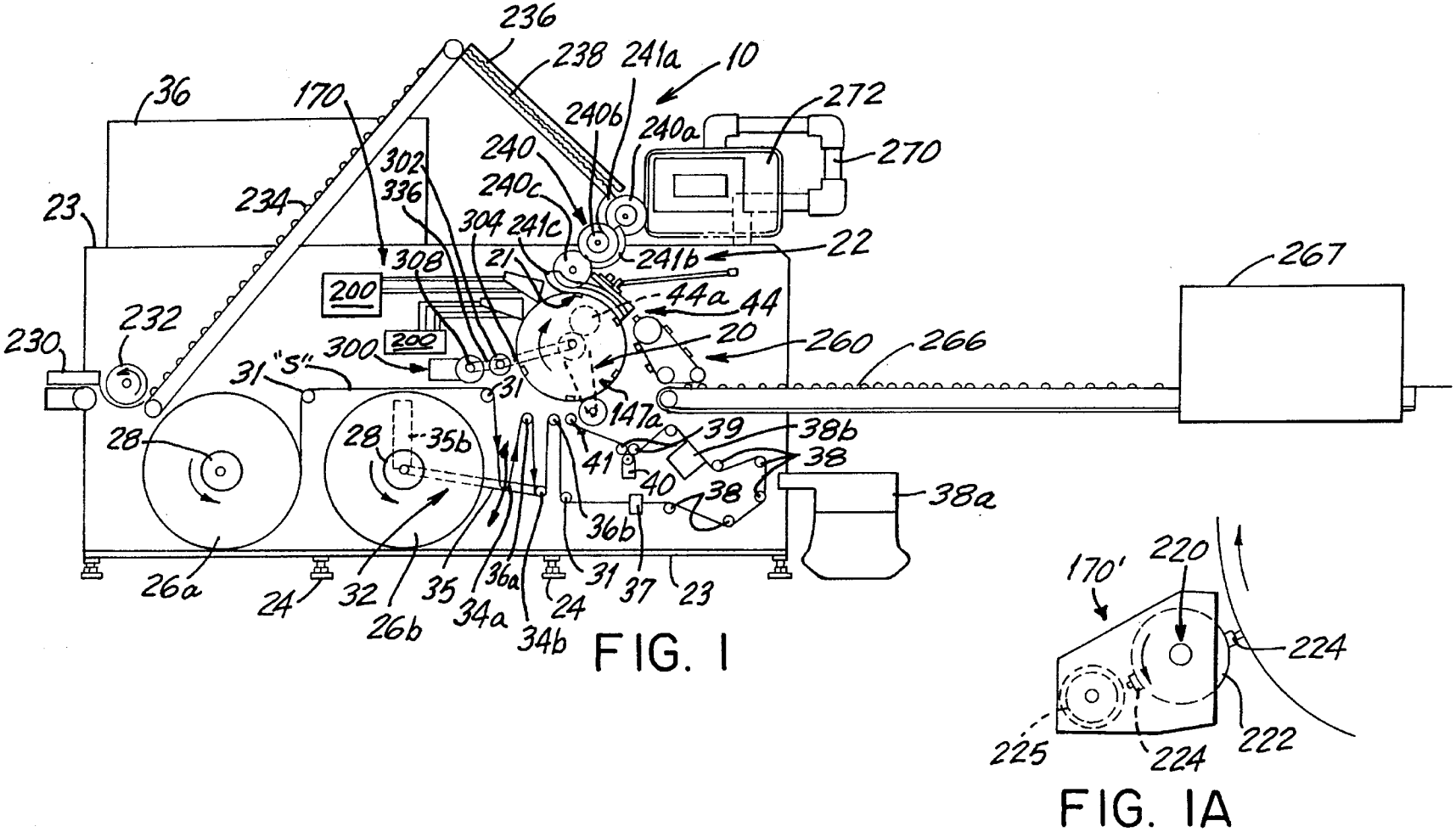
FIG. 1 is a schematic side elevation view of the apparatus that applies labels unto small cylindrical articles in accordance with one embodiment of the present invention.
FIG. 1A is a schematic side view of an alternative embodiment of the solvent application system.

Referring now to FIG. 1, there is illustrated at 10 a schematic illustration of an apparatus for applying high quality, heat shrinkable, thin film polymeric labels to small, cylindrical articles, typically less than about 1.75 inches in diameter while forming seams of high quality. Although the description of the invention discusses labeling of articles 1.75 inches less in diameter, the retarding mechanism of the invention as described below can be used with wrap around labeling of larger cylindrical articles.

Throughout this description and in the drawings, the cut labels will be referred to by the letter "L." In accordance with the present invention, labeling of small cylinder, attractive articles, such as those magnetically attractive articles formed from a metallic casing (such as dry cells), can now be accomplished with even higher quality seams than was known before. Unless otherwise noted, the description will proceed by describing the labeling of drycell batteries.

The apparatus 10 is suitable for high quality cylindrical labeling of small cylindrical articles, and most notably, magnetically attractive, cylindrical dry cells (articles) "A". These articles, however, require thin film labels, typically having a thickness less than 0.0035 inches. The described apparatus can also be used for wrap around labeling of many different types of small, cylindrical articles, such as lipstick containers, cylindrical, powdered metal products, and many other articles.

The label material is preferably formed from a heat shrinkable, thin film polymer label material. Examples of acceptable film materials include those formed from polyvinyl chloride, polyester, and polystyrene. The label material typically has a thickness under 0.0035 inches, a thickness corresponding to the thinner label material thickness commonly used for labeling smaller cylindrical articles such as drycells, lip balm and other similar containers.

Typically, the drycells to be used with the present apparatus are about 1.75 inches in diameter or less, corresponding to the diameter of a "D" size (about 1.5 inches diameter) or smaller drycell. For purposes of understanding and description in this application, the size of the articles are described relative to an "AA" size battery, (slightly greater than 0.5 inch diameter and about two inches long, and weighing approximately 0.5 ounces). Any dimensions used with the associated components of the apparatus 10 are designed for use with labeling a small "AA" size battery. Typically, the labels used for wrapping this small size drycell are about 49×49 mm square (about 2.0×2.0 inches).

Because of the demanding label and seam quality requirements necessary for labeling these smaller drycells ("D" size or less), the labels L heretofore have been pre-seamed on a continuous basis, and then applied as a sleeve to the article. With conventional sleeve technology where the sleeve is first formed on a mandrel and then transferred to an article, a typical article size ranged in size usually less than two inches diameter and typically less than 1.75 inches diameter. Thus, heretofore, smaller articles, such as the described drycell batteries, had to be used as a mandrel and a sleeve placed thereover, or some other labeling method used besides wrap around.

The apparatus 10 is used for wrapping a label around a large variety of different small articles A requiring high quality labels, such as the described drycell batteries, lip balm containers, lipstick tubes and other similar articles where consumer confidence and expectations for the product are high. Such high quality labeling requires end-to-end label alignment on the articles A without mismatching, so that different colored zones, lettering, and trade logos printed on the label are aligned correctly after the article is wrapped. A pressure applicator, indicated at 22, provides a biasing force against the articles for wrapping, and has means for changing the biasing force exerted against selected sides of the article so as to aid in correct label alignment such as described in greater detail in the copending '433 application.

Additionally, the construction of the label transport drum, (which is indicated generally at 20), provides proper control over label retention, label movement with the drum, leading edge label transfer to an article at an article wrapping position, (indicated generally at 21, FIGS. 1 and 2), and label blow-off necessary to insure high quality labeling of small cylindrical articles such as drycell batteries with heat shrinkable, polymeric film labels.

The label transport drum 20 in the illustrated embodiment is a six pitch drum of about 54 inch circumference and has six predetermined label areas spaced about nine inches apart which receive labels for adhesive and solvent application and wrap around labeling. This configuration is beneficial for use with labels that are about four and a half inches or less long, corresponding to labels for wrapping drycell batteries that are "D" size or less. A twelve pitch drum can also be used with twelve label areas spaced about four and one half inches apart. The drum and pitch size can vary depending on the label, the type of articles to be covered, the label thickness, the speed of desired operation, and other factors.

Referring again to FIG. 1, in accordance with the present invention, the apparatus 10 includes a frame 23 for supporting major components such as the label transport drum, adhesive and solvent applicators, and rolls of continuous label material. The frame 23 includes leg supports 24 for supporting the frame on the floor. Two rolls 26*a*, 26*b* of label material are supported for rotation on the frame 23. The frame 23 supports an unwind drive motor and dual roll support spindles 28 which support the rolls of label material.

The unwind drive motor unwinds the film and provides tension to the film as the film is withdrawn to prevent slack buildup in the film during operation. When one supply roll is in use, the other provides a reserve roll which is used when the other roll is depleted. The label material is pre-printed with identifying indicia, or alternatively, a printing stamp or roller (not shown) may be positioned adjacent the label supply roll for printing directly onto the label material as it is withdrawn from the supply roll. The present illustrated apparatus 10 can be designed for wrapping dry cells A that are fed in dual, parallel rows to each other or designed for feeding a single row of dry cells.

As indicated in FIG. 1, label material is fed as a film strip "S" from the first supply roll 26*a* onto stationary idler rolls 31 and into a festooned dancer roll assembly indicated generally at 32, having a plurality of individual dancer rolls 34*a*, 34*b*, which are rotatably secured to a dancer arm 35. The dancer arm 35 is pivotally mounted on the spindle 28 carrying the second roll 26*b*, and is free to pivot, i.e., swing up and down.

Figure 4:
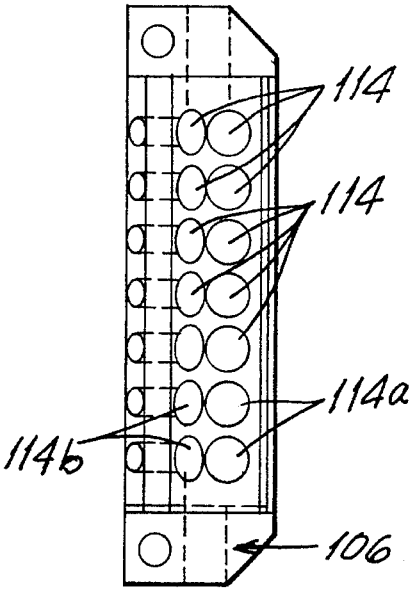
FIG. 4 is an enlarged plan view of the article receiving member.

The film strip "S" passes from the second idler roll 31 onto the first dancer roll 34*a*, up and around a first stationary idler roll 36*a*, down and around the second dancer roll 34*b* and up and around a second idler roll 36*b*. A potentiometer 35*b* is linked to the pivot of the dancer arm 35 (FIG. 4) and controls the speed of an unwind motor 27 by feedback signals to a controller which is operatively connected to the unwind motor. As the dancer arm 35 is raised, the potentiometer 35*b* sends signals to the controller, which signals the unwind motor to rotate at a faster rate of speed and feed out more film to the dancer roll assembly. The increase in feed rate causes the dancer arm 35 to drop into a lower position.

The strip "S" passes over another idler roll 31 and through a registration sensor 37, which can be a fiber optic sensor. The registration sensor 37 detects light-dark areas corresponding to 1) printed and 2) nonprinted areas (corresponding to the separation between respective printed labels). The signals indicate the transition from dark to light areas of film strip "S", indicating the real time location of leading and trailing edges of respective labels. The generated signals are communicated to the controller 36.

The strip 28 passes over idler rolls 38 and through a pair of feed rolls 39 rotating upward and outwardly from each other for pulling the strip through the dancer roll assembly 32. The feed rolls 39 are rubber coated and powered by an A.C. servomotor 40 which is operatively connected to the controller 36. The servomotor 40 drives the film at a rate that is proportional to the rate of speed of the label transport drum.

Before the strip passes through the servomotor driven feed rolls 39, a laser marker 38*a* marks the strip with an identifying code at the area defined by printed indicia corresponding to each label. Alternately, the laser marker 38*a* could be positioned and adapted for marking drycells and other articles after wrap around labeling. The strip then passes through a web tracking unit (shown by block 38*b*, FIG. 1), which senses the position of the strip edge using an ultrasonic eye. Based on the detected edge position, the web tracking unit maintains proper edge-to-edge tracking of the strip to ensure that it is later aligned properly during transfer onto the label transport drum.

The strip "S" passes over an idler roll 41*a* and into a cutting assembly where the film is cut into labels by means of a separate cutting drum and knife assembly, indicated at 42. The cut labels are then transferred onto the label transport drum 20 at a label transfer position defined by the close proximity point between the label transport drum 20 and the cutting drum 42. In this description the labels are sized and cut for wrapping about AA size batteries, corresponding to labels that are about 49 mm×49 mm square, i.e., about two by two inches. The labels are retained on six evenly spaced label retaining insert plates 100 by vacuum means such as described in greater detail in the copending '433 application. In an alternate embodiment, the drum is a twelve pitch drum. This twelve pitch drum is preferred in some labeling applications and has been found beneficial with size AA batteries.

The label transport drum typically is formed from steel construction and has six cut-outs in the illustrated embodiment dimensioned to receive six label retaining insert plates 100, or as noted before, twelve plates to form a twelve pitch drum. The label retaining insert plates 100 are formed from steel or other rigid, high strength material that can resist the high speed impact of batteries and other small articles as they are fed onto the drum as well as the high rotative speeds and vibration associated with heavy mechanical machinery.

Figure 3A:
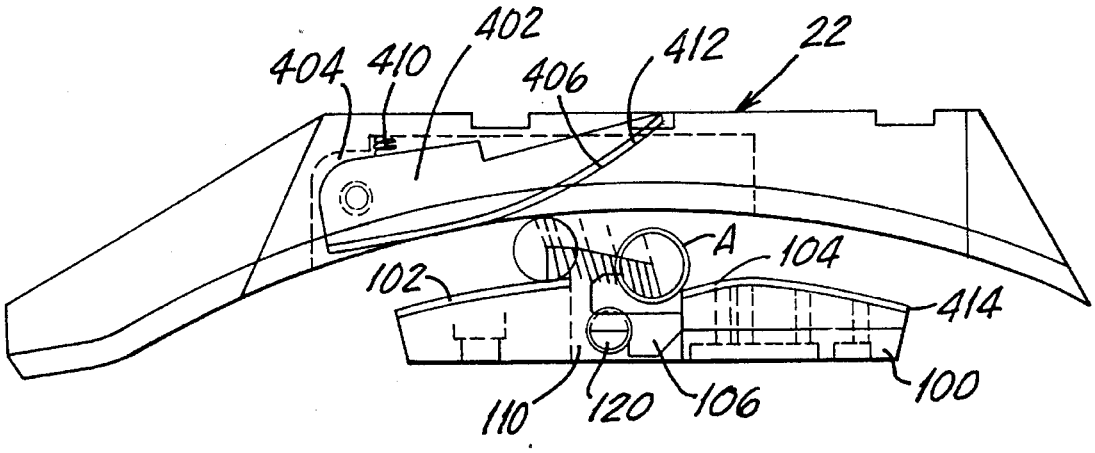
FIG. 3A is a schematic side elevation view showing the profile of the insert plate relative to the pressure plate and articles which rolls thereon.

Each label retaining insert plate 100 is substantially rectangular configured and has a top surface 102 that is configured substantially similar to the curvature of the drum surface except for a profiled drum surface 104 positioned before an article receiving member, indicated generally at 106, (FIG. 3A). The articles "A" roll on the profiled drum surface 104, where they are wrapped and then roll into a pocket 108 of the article receiving member 106.

Figure 2:
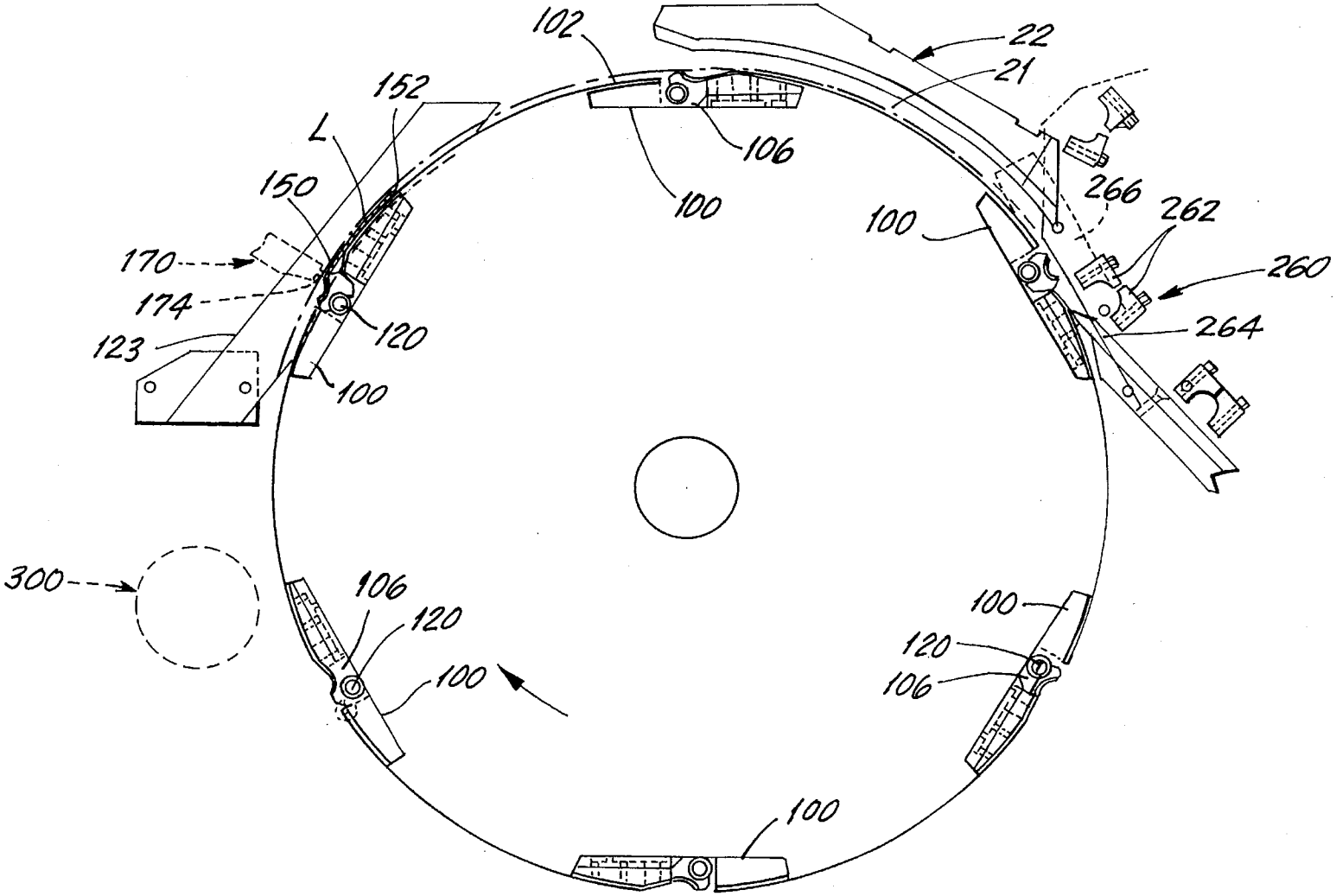
FIG. 2 is a schematic side sectional view of the label transport drum, inserts, pressure pad and article receiving members showing various pivoting positions of the article receiving members as the drum rotates.

As shown in FIG. 2, each of the inserts 100 on the label transport drum includes a slot 110. Each slot 110 has pivotably mounted therein, the article receiving member 106. Each article receiving member 106 has a concave surface with two opposing, rearward and forward-most exposed edges 112, 113 to form the article receiving pocket 108. As illustrated in FIG. 2, in a normal position, the article receiving member 106 is rocked forward so that the forward most exposed edge 112 is lower than the rear exposed edge 113.

Figure 8:
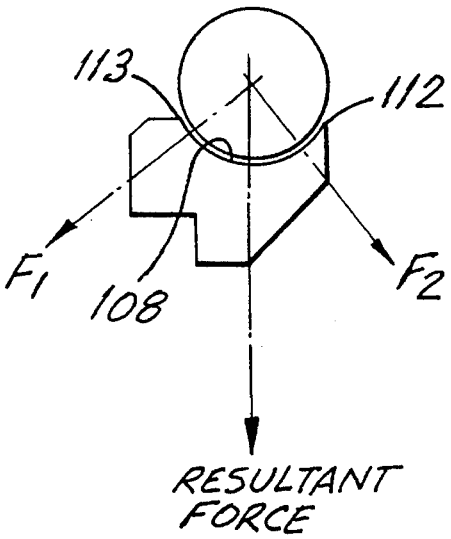
FIG. 8 is a diagram showing the resulting forces applied by magnets on a dry cell battery received in the article receiving member.

Each article receiving member includes within each pocket 108 a plurality of magnets 114 to impart a magnetic attractive force onto magnetic articles "A", such as dry cell batteries, and to retard rotation when the article has rolled into the pocket 108. The article receiving member 106 has two rows of magnets, one row positioned on each side adjacent respective exposed edges 112, 113. Thus, once an article falls into the pocket 106, it is retained thereto by the magnets which exert an attracting biasing force thereon, as shown by the force diagram of FIG. 8. A first row of magnets 114*a* exerts a magnetic attractive biasing force at about 450 to the normal line. A second row of magnets 114*b* exerts a force 900 to the first force, which results in a net downward force directly over the label seam, as shown in FIG. 8.

Figure 5:
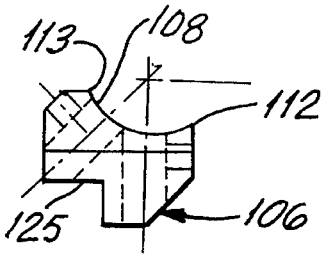
FIG. 5 is an enlarged side sectional view of the article receiving member.
Figure 6A:
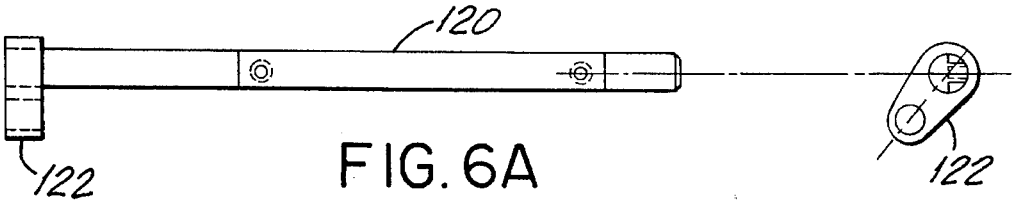
FIG. 6A is a schematic, assembly view of the cam mechanism used with the present invention.
Figure 6B:
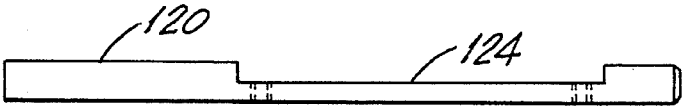
FIG. 6B is a side elevation of the rod used in the cam mechanism.
Figure 7:
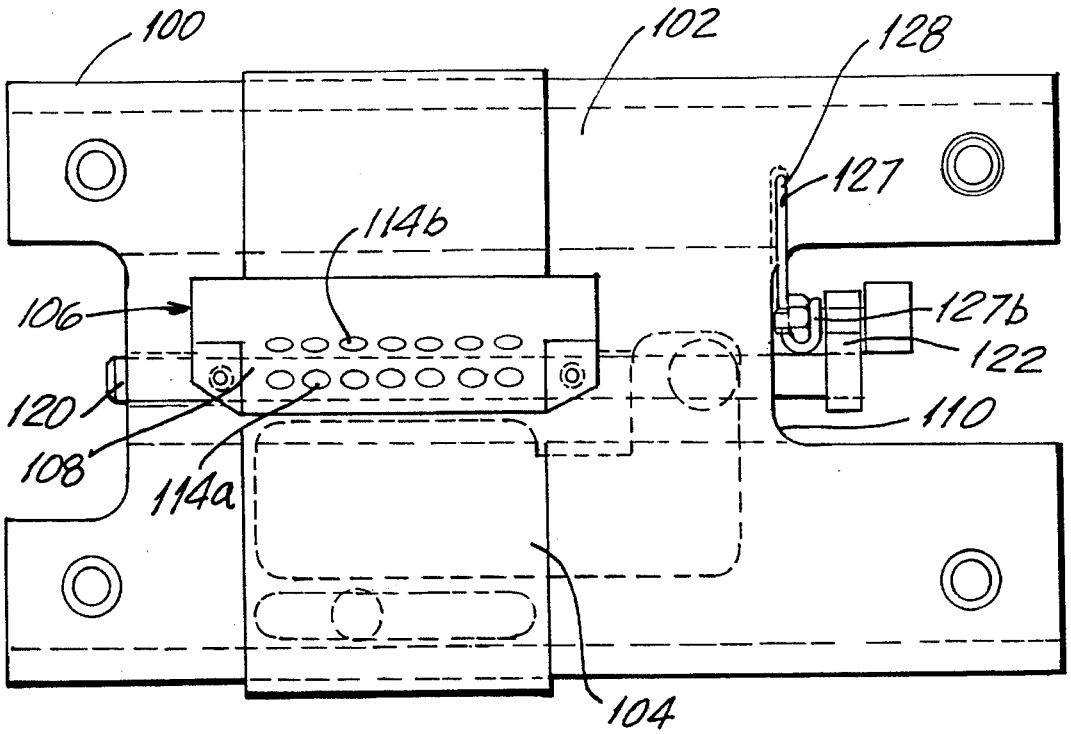
FIG. 7 is a plan view of a label retaining insert plate showing the location of the spring which biases the article receiving member.

The article receiving member 106 is pivotably mounted within the slot by a rocker shaft 120. A cam 123 (FIG. 2) is mounted on the machine frame adjacent the area where solvent is to be applied to the trailing edge of labels and spaced from the outer surface of the drum. A cam follower 122 (FIG. 6A) is mounted on the shaft 120 and extends outward from the drum surface as shown in FIG. 2. As the drum rotates, the cam follower 122 engages the cam 123 and thus pivots the rocker shaft 120 depending on the configuration of the cam surface. The medial portion of the rocker shaft 120 includes a notched surface 124 (FIG. 6B) which receives the article receiving member 106 by a corresponding notch 125. (FIG. 5).

A tension spring 127 is connected to the rocker shaft 120. One leg 127*a* of the tension spring, indicated generally at 127 is positioned against a plate spring receiving groove 128 of the label retaining insert plate, while the other leg 127*b* of the spring 127 exerts outward pressure on the cam follower 122. As illustrated in FIG. 2, the article receiving member 106 is normally biased so that the outside receiving member 106 is rocked forward so that the forward most exposed edge 112 is lower than the rear exposed edge 113.

The labels are initially applied to each insert so that the label lies over the profiled drum surface 104. The trailing edge 150 of the label rests on the forward-most exposed edge 113 of the concave surface and the leading edge 152 rests on the forward-most part of the profiled drum surface 104. (FIG. 2).

The system is initially purged by rotating the label transport drum and cutting drum and blowing any scrap labels from the cutting drum and label transport drum. The film is then advanced. During this initial film feed, the feed rate is synchronized with the detected position and velocity of the label transport drum 20 and the sensed film indicia. As a result, the film feed is advanced or retarded for the first four or five cut labels until the film feed is synchronized so that the trailing edge aligns at the cut point during cutting.

These first cut labels, if transferred, are scrap and can be ejected from the label transport drum at a label blow-off area. The film feed is stopped. Then the entire apparatus is placed into a jog mode to initially begin wrap around labeling. The film is then fed normally, the leading edge transferred, while cutting occurs at the trailing edge of the label. If film tension or slight differences in label dimension cause cutting to occur slightly off the trailing edge, the registration sensor, being positioned a predetermined distance from the cut point, detects the trailing edge, inputs that data to the controller, and based on the known distance and the feed rate of the servomotor driven feed rolls, makes corresponding adjustments to the feed rate so that the trailing edge of a label is precisely aligned with the cut point. Additionally, if one parameter of the system changes, such as by knocking the registration sensor from its set position, the operator can visually inspect film feed on the cutting drum and adjust the film feed so that the trailing edge aligns with the cut point at cutting.

As the vacuum secured label moves with the rotating label transport drum 42, the leading edge of the label advances to an adhesive applying position where adhesive is supplied from an adhesive application system 300 (FIG. 1). The adhesive application system 300 includes a rotary pad print head 302, which is timed to rotate at substantially same surface speed with the label transport drum. The rotary pad print head 302 includes outwardly extending adhesive print pads 304. The print pads 304 typically are rectangular configured, and include a pad face which engages the label so that the adhesive is printed onto the leading edge of the label. The print pads 304 engage a rotating gravure roller 308 which transfers the adhesive to the print pads 304. The depth of indentations in the gravure roller 308 determine the amount of transferred adhesive. The print head 302 is timed to rotate with the label transport drum such that the print pad 304 engages the leading edge of the label at the same surface speed of the drum so that the adhesive is "printed" against the leading edge of the label.

Both the gravure roller 308 and the rotary pad print head 302 can be driven together from the label transport drum by suitable transmission means 336 such as gears, chain or belt interconnecting the support shafts. In one aspect of the present invention, the rotary pad print head 302 is mounted on a shaft (not shown in detail) and rotates at a three-to-one ratio to the label transport drum. The print head 302 preferably includes a clutch mounted on the shaft for engaging and disengaging the print head from its drive shaft system (not shown in detail). The clutch engages and disengages, moving the print head out of rotative engagement with the gravure roller and label transport drum.

As noted in the foregoing copending '573 patent application, a cold adhesive is more desirable than a hot melt adhesive because a hot melt adhesive tends to distort the thin film label material, forming an adhesive joint of poor appearance and low seam quality such as would occur if the method and apparatus were used as disclosed in U.S. Pat. No. 4,844,760 to Dickey.

As used herein, the term cold adhesive is defined as those adhesives that are viscous at room temperature, as compared to conventional hot melt adhesives that are inherently solid at room temperature and become viscous only at elevated temperatures. Potential cold adhesives could be water or solvent based adhesives with suspended solids, and potentially rubber-based solvent and latex adhesives. Other adhesive applicator mechanisms also could be used as long as adequate adhesive is neatly and aesthetically printed according to manufacturing and quality guidelines. Details of one type of adhesive supply system 300 which can be used for the present invention are described in greater detail within the incorporated by reference '433 copending patent application.

After the cold adhesive is applied to the area adjacent the leading edge of the label, a solvent application system, indicated generally at 170 (FIG. 1), evenly applies solvent without mottling or solvent streaking in a precise pattern to the area adjacent the trailing edge of the label. The preferred solvent is an organic solvent and reacts to the film material. THF has been found to be an acceptable and desirable solvent.

The solvent reacts with the film material, dissolving a portion of the area adjacent the trailing edge to provide a tacky quality to that area, so that the trailing edge can be retained to the leading edge by a solvent-seal bond when the label is circumferentially wrapped around the article and the trailing edge overlaps the leading edge. Depending on the article used, and type of labeling, (such as forms of plastic articles), the trailing edge of the label can be positioned adjacent to, but not overlying the leading edge.

The solvent is preferably applied after the adhesive is applied, to ensure that the solvent does not evaporate before the trailing edge of the label has overlapped the leading edge. As illustrated, the solvent application system 170 is positioned ahead of the adhesive applicator 300 in the direction of drum rotation so that the leading edge of the label first engages the adhesive applicator 300. Then, the trailing edge of the label engages the solvent application system 170. This arrangement is preferred as compared to the reverse arrangement disclosed in the drawings of the copending parent application where the adhesive applicator is positioned after the solvent applicator, similar to the Dickey '760 patent.

In the preferred, illustrated embodiment of FIG. 1, the solvent application system 170 includes two static wiper assemblies 172*a*, 172*b*, which are configured similar to each other. Each assembly supports a wiper body having an outwardly extending wiper tip 174 (FIG. 2). Solvent is contained in the closed reservoir 200. The reservoir 200 and a metering pump draws solvent from the reservoir 200 and through a solvent delivery line to a wiper assembly where the solvent is drip fed onto a wiper body. Greater details of the type of wiper assemblies which may be used are found in the copending '433 patent application.

The end of each wiper tip is positioned adjacent the drum surface. As the drum rotates, the article receiving member 106 approaches that position, and the cam follower 122 engages the cam 123. The cam 123 forces the article receiving member 106 to pivot (rock) 30° in a counterclockwise direction relative to the drum so that the trailing edge of the label rests on the forward most concave edge 113 and is moved outward to engage the wiper tip (FIG. 2).

The solvent application system in another embodiment is illustrated schematically in FIG. 1A as 170', and includes a wiper member, indicated generally at 220, formed as a rotary printing head 222 that is mounted for rotation adjacent the label transport drum. The rotary printing head 222 includes two outwardly extending, flexible tips 224 that taper outward. The tips 224 are formed from a resilient material that is not highly reactive to the solvent. The tips 224 engage a solvent gravure roller 225. The flexible tips 224 are resilient to allow deflection of the tip against the label and drum surface, while retaining at least some stiffness to exert a wiping force against the label. Materials which may be used include felt, a cloth covering a felt wiper member, a soft cord, some silicones and urethanes, as well as other materials that are not highly reactive to the solvent, but have appropriate resilience for a rotating wiper.

By timing the maximum speed differential at the time the wiper tip is in contact with the trailing edge of the label, a wiping action can be produced. If the wiper tip is moving slower than the label transport drum, the solvent is wiped toward the trailing edge of the label. Conversely, if the wiper tip is moving faster than the label transport drum, the solvent is wiped from the trailing edge of the label forward. By timing the occurrence at the maximum speed differential points, the amount of wiping action can be varied. A directly driven elliptical gear arrangement has been found beneficial to provide the wiper speed differential that is timed with the label transport drum. The gears can also be set to yield an applicator surface speed equal to that of the label transport drum.

The speed differential between a wiper tip and label moving with the drum is maximized with the use of the static wiper assemblies 172*a*, 172*b* as described above.

As shown in FIG. 1 the pressure applicator 22 preferably has one control shaft that is turned for changing the biasing force exerted on the articles as they move on the label transport drum during article wrapping. Greater details of this type of support mechanism which may be used are set forth in the copending '433 patent application.

The pressure plate also includes a follower 402 formed as a finger plate which is pivotally mounted at one end to the pressure plate within a slot 404 (FIG. 3A). The follower 402 includes a profiled surface 406 which engages the article A as it rolls along the profiled surface of the drum to ensure a substantially constant pressure as the article rolls along the profiled drum surface. A spring 410 exerts downward pressure onto the follower, which includes a surface 412 having a material such as rubber to enhance friction and ensure contact and rolling action of the article as it rolls along the profiled drum surface 104. The profiled drum surface 104 also includes a surface layer 414 formed from a friction enhancing substance, such as rubber. The article is wrapped as it rolls along the profiled drum surface. The profiled drum surface 104 is configured for distancing the article from the pressure plate 22 and allowing the article to gently roll into the article receiving pocket.

As shown in greater detail in FIG. 1, the drycells A are initially conveyed on a flat belt conveyor 230 and into a star transfer wheel 232. The star transfer wheel 232 rotates, transferring the drycells A sequentially into an inclined belt conveyor 234 to provide a sufficient head of drycells for process flow control. The drycells can be fed in a double row, side-by-side manner, each pair of drycells having complementary pairs of labels to be applied thereto. For purposes of illustration, the figures show only one row of fed drycells—the other row of article receiving positions on the star transfer wheel being empty. The apparatus can be readily designed for working with either one or two rows of drycells fed thereto.

The belt conveyor transports the drycells A into an inclined gravity chute 236 having a serpentine channel 238 for slowing the movement of the drycells A from the height of the inclined belt conveyor. The drycells A then are fed into a serpentine timing wheel assembly, indicated generally at 240, where a tangential, rotative movement is imparted to the drycells A. The drycells A traverse around the serpentine timing wheel assembly 240, which includes three star transfer wheels 240*a*, 240*b*, 240*c* mounted on spindles connected to the frame. Each transfer wheel has article receiving positions for holding and conveying the drycells.

The star transfer wheels 240*a*, 240*b*, 240*c* accelerate movement of the drycells from one transfer wheel to the next. Each succeeding transfer wheel has fewer article receiving positions 242, thus requiring each succeeding transfer wheel to rotate faster.

The first transfer wheel 240*a* includes more positions than the third transfer wheel 240*c*. Thus, the transfer wheels increase in rotational speed from the first to the third wheel, accelerating movement of the drycell. As a drycell leaves the third star transfer wheel 240*c*, the drycell engages the article entrance area 250 of the downwardly inclined pressure plate 446 of the pressure applicator 22, which imparts a spin to the drycell to aid in moving the article into tangential spinning engagement with the surface of the label transport drum 20.

Each star transfer wheel 240*a*, 240*b*, 240*c* includes a shield 241*a*, 241*b*, 241*c* (FIG. 1) which is spaced from the other periphery of the respective star transfer wheel to form an article channel having an inner article engaging surface which the drycells engage. The shields 241*a*, 241*b*, 241*c* prevent the drycells from spinning out of the article receiving position 242 due to centrifugal forces exerted against the drycell. Other details of the pressure plate and transfer wheels are set forth in the copending '433 application.

An endless lug chain assembly, indicated generally at 260 (FIG. 1) is positioned adjacent the label transport drum at a position where the dry cells would initially fall from the label transport drum 20, at the point adjacent to the end of the pressure plate where the dry cells exit therefrom. The lug chain assembly 260 includes pairs of complementary article engaging grips 262 (FIG. 2) that are fixed to the lug chain. As the lug chain and complementary pairs of grips rotate into close relation to each other and to the end of the pressure plate, the grips engage a dry cell and move the dry cell onto a conveyor, positioned tangent to the drum surface. A stripper plate 264 is fixed adjacent the drum near the article discharge area and engages wrapped articles to aid in releasing them from the pocket and attractive magnetic field holding them therein. As shown in FIG. 2, a second cam 266 is mounted outside the drum adjacent the article discharge area and causes the article receiving member 106 to rock forward, so that forward and rear edges 112, 113 are substantially coplanar with the drum surface. This facilitates article engagement with the stripper plate 264. Alternatively, a series of star transfer wheels could be used to remove drycells from the surface of the drum. It has been found, however, that the described lug chain 260 is advantageous for its intended purpose, and less complex than the star transfer wheel, which could misdeliver drycells from one wheel to the other.

METHOD OF OPERATION

During operation, cut labels are applied onto the label retaining insert plate 100 so that the label overlies the profiled drum surface 104 and the trailing edge 150 overlies a medial portion formed by the concave pocket 108. As the drum rotates, the label moves into a position adjacent the adhesive applicator 300 and adhesive is supplied onto the leading edge 152 of the label. The drum rotates further and the trailing edge 150 of the label is positioned adjacent the solvent application station. At this time, the cam 123 rotates (rocks) the article receiving member 106 thirty degrees counterclockwise so that the trailing edge 150 of the label is positioned outward from the surface of the drum by the forward-most concave edge 113 and engages the wiper tip 174. As the cam follower 122 disengages from the cam 123, the spring 127 biases the article receiving member 106 forward (clockwise) to the full-forward position as shown in FIG. 2.

At this time, the drum continues rotating and the article has entered an article wrapping area between the pressure plate and drum surface as shown in FIG. 2. The follower 402 engages the article while the article rolls along the profiled drum surface 104 and is wrapped. The article engages the leading edge 150 of the label and retained thereto. The article continues rolling along the profiled drum surface 104 and is engaged by the follower 402.

Figure 3B:
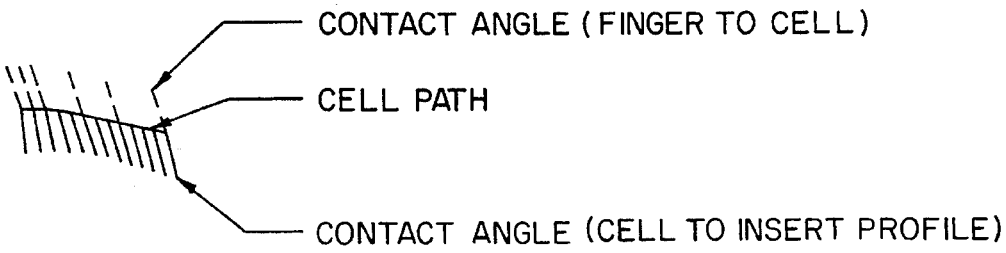
FIG. 3B is a profile plan of the contact of the finger to the cell.

FIG. 3 illustrates the profiling between the finger-to-cell, the cell path and the contact angle regarding the cell-to-insert profile. Once the article is wrapped, it rolls into the pocket 108, where the magnets retain the article thereto so that the weight and attractive magnetic force forces the article against the overlapping seam. The article is retained therein, allowing sufficient time for the solvent to react. The article receiving member 106 then rotates eighteen degrees counterclockwise by means of the pressure exerted against the cam follower 123 from the second cam 266, so that the concave edges 112, 113 are again level with the drum surface for article discharge. The articles then are discharged.

It should be understood that the foregoing description of the invention is intended merely to be illustrative thereof, and that other embodiments, modifications and equivalents may be apparent to those skilled in the art without departing from its spirit.

That which is claimed is:

1. An apparatus for applying a label onto a small cylindrical article comprising, a label transport drum that defines a central axis, means for supplying a label onto the surface of said drum, means for rotating said drum about its axis so that the label moves with the drum into an article wrapping position, means for delivering small cylindrical articles onto the drum surface and into rotative engagement with the label as the label moves into the article wrapping position for wrap around labelling so that the trailing edge overlaps the leading edge, and including means for retarding rotation of the article after wrapping for a period of time while the drum continues its rotation so that the article rests on the overlapping seam while allowing sufficient time for any solvent or adhesive applied thereon to react with the label material.

2. The apparatus according to claim 1 wherein said articles are magnetically attractive, and said means for retarding rotation of said articles includes magnet means for exerting a magnetic biasing force on the article to prevent rotation thereof.

3. The apparatus according to claim 2 including an article receiving pocket positioned on the surface of the drum into which an article rolls after being wrapped, and said magnet means comprises a plurality of magnets positioned in said pocket for exerting an attractive biasing force to prevent article rotation.

4. The apparatus according to claim 3 including a pressure plate for exerting pressure onto the article during wrapping.

5. The apparatus according to claim 4 wherein said pressure plate includes a spring biased follower pivotally mounted on the pressure plate for engaging said article as it is wrapped.

6. The apparatus according to claim 5 wherein said follower disengages from said article after it is wrapped.

7. The apparatus according to claim 1 including a profiled drum surface on which the article rolls before being retarded in its rotation to guide the article into its retarded position.

8. The apparatus according to claim 1 wherein said drum rotates approximately 40 degrees while the article is retarded in its rotation before discharge from the drum surface.

9. The apparatus according to claim 8 including means for engaging said article to aid in withdrawing said article from said drum surface after label wrapping.

10. The apparatus according to claim 1 including means for applying an adhesive onto the leading edge of the label, and means for applying a solvent onto the trailing edge of the label.

11. An apparatus for applying a label onto a small cylindrical article comprising, a label transport drum that defines a central axis, means for supplying a label onto the surface of said drum, means for rotating said drum about its axis so that the label moves with the drum into an article wrapping position, means for delivering small magnetically attractive, cylindrical articles into rotative engagement with the drum and the label as the label moves into the article wrapping position for wrap around labelling so that the trailing edge of the label overlaps the leading edge, a plurality of slots formed in the surface of the drum, an article receiving member having a concave surface with two opposing exposed edges to form an article receiving pocket, said concave surface being configured for receiving an article therein, means for pivotally mounting said article receiving member within the slot, and a plurality of magnets positioned in said article receiving member for exerting an attractive biasing force on the article toward the insert so as to retard rotation of the article after wrapping for a period of time while the drum continues its rotation so that the article rests on the overlapping seam and applies pressure while allowing sufficient time for any solvent or adhesive applied thereon to react with the label material.

12. The apparatus according to claim 11 including a profiled drum surface on which the article rolls before engaging the concave article receiving surface, wherein said label is positioned on said profiled surface to allow wrapping the said article as the article rolls along said profiled surface toward said concave article receiving surface.

13. The apparatus according to claim 12 including means for applying pressure onto the article as it rolls along the profiled surface to maintain continuous rolling action and to ensure that the label is wrapped tightly about the article.

14. The apparatus according to claim 11 including means for applying an adhesive onto the leading edge of the label.

15. The apparatus according to claim 11 including means for applying solvent onto a trailing edge of a label.

16. The apparatus according to claim 11 wherein the trailing edge of the label is positioned in a medial portion of the concave article receiving slot, and including means for pivoting said article receiving member backward so that the forward most exposed edge is raised to lift the trailing edge of the label into engagement with a solvent applicator.

17. The apparatus according to claim 11 including an article discharge area positioned after said pressure application means and including means positioned at the article discharge area for stripping the article from the pocket after the article has moved with said drum to said article discharge area.

18. The apparatus according to claim 11 wherein said means for pivotably mounting said article receiving member comprises a rocker shaft, a cam mounted adjacent said drum, and cam follower means mounted on said rocker shaft, said cam exerting a camming force on said cam follower so as to pivot said rocker shaft a predetermined amount at a predetermined time.

19. The apparatus according to claim 11 wherein said drum rotates approximately 40 degrees while the article is retarded in its rotation before discharge from the drum surface.

20. An apparatus for applying a label onto a small cylindrical article comprising, a label transport drum that defines a central axis, means for supplying a label onto the surface of said drum, means for rotating said drum about its axis so that the label moves with the drum into an article wrapping position, means for delivering small magnetically attractive, cylindrical articles into rotative engagement with the drum and the label as the label moves into the article wrapping position for wrap around labelling so that the trailing edge overlaps the leading edge and forms a bond, a plurality of slots formed in the surface of the drum, an article receiving member having a concave surface with two opposing exposed edges to form an article receiving pocket, said concave surface being configured for receiving an article therein, each slot including means for pivotally mounting an article receiving member within said slot so that the exposed edges of the concave surface are substantially coplanar with the surface of said drum, a plurality of magnets positioned in each article receiving member for exerting an attractive biasing force on the article toward the member pressure plate means having an article engaging surface spaced from the drum surface for engaging and applying pressure onto the articles as they are conveyed onto the label transport drum, a profiled drum surface positioned before the article receiving member in the direction of drum rotation, and on which an article rolls before engaging the article receiving pocket and on which article wrapping occurs, said profile drum surface being configured for distancing the article from the pressure plate so that the article is gradually guided into said article receiving slot, and a spring biased follower pivotally connected to the pressure plate for engaging the article as it rolls on the profiled drum surface to maintain rolling action and ensure labelling of the article without developing creases, wherein said article rotation is retarded by the biasing force exerted by said magnets when the article is positioned in the article receiving pocket so that the article rests on the overlapping seam and applies pressure while allowing sufficient time for solvent or adhesive applied to the label edge to react with the polymer label material.

21. The apparatus according to claim 20 wherein said pressure plate includes a slot, and said follower comprises a finger plate pivotally mounted at one end to said pressure plate within said slot, said finger plate including a profiled surface which engages the article as it rolls along the profiled surface of the drum to ensure a substantially constant pressure as the article rolls along the profiled drum surface.

22. The apparatus according to claim 20 including means for applying an adhesive onto the leading edge of the label.

23. The apparatus according to claim 20 including means for applying a solvent onto the trailing edge of the label.

24. The apparatus according to claim 20 wherein said drum rotates approximately 40 degrees while the article is positioned in the article receiving pocket.

25. The apparatus according to claim 20 wherein the label is positioned on the profiled drum surface so that article wrapping occurs as the article rolls along the profiled drum surface.

26. The apparatus according to claim 20 wherein the trailing edge of the label is positioned in a medial portion of the concave article receiving pocket, including means for pivoting said article receiving member backward so that the forward-most exposed edge is raised to lift the trailing edge of the label into engagement with a solvent applicator.

27. The apparatus according to claim 20 including an article discharge area positioned after said pressure plate, and including means positioned at the article discharge area for stripping the article from the pocket after the article has moved with said drum to an article discharge area.

28. The apparatus according to claim 20 wherein said means for pivotably mounting said article receiving member comprises a rocker shaft, a cam follower mounted on said shaft, and a cam mounted adjacent said drum for exerting a camming force on said cam follower so as to pivot said rocker shaft a predetermined amount at a determined time.

29. A method for applying a label onto a small cylindrical article comprising, supplying a label onto the surface of a label transport drum that defines a central axis, rotating the drum about its axis so that the label moves with the drum into an article wrapping position, delivering small cylindrical articles into rotative engagement with the drum and the label as the label moves into the article wrapping position for wrap around labelling so that the trailing edge overlaps the leading edge, and retarding rotation of the article after wrapping for a period of time while the drum continues its rotation so that the pressure is applied on the overlapping seam to allow a dwell time for any solvent or adhesive applied thereon to react with the label material.

30. The method according to claim 29 wherein the articles are magnetically attractive, and including the step of exerting a magnetic biasing force on the article to prevent rotation thereof.

31. The method according to claim 29 including the step of rolling the article into an article receiving pocket positioned on the surface of the drum.

32. The method according to claim 29 including exerting pressure onto the article during label wrapping by means of a pressure plate.

33. The method according to claim 32 including engaging the article as it is wrapped with a spring biased follower pivotally mounted on the pressure plate.

34. The method according to claim 33 including disengaging the follower from the article after the article is wrapped.

35. The method according to claim 29 including rolling the article before it is retarded in its rotation on a profiled drum surface for gently guiding the article into its retarded rotation position.

36. The method according to claim 29 including retarding rotation of the article approximately 40 degrees of drum rotation after it is wrapped.

37. The method according to claim 29 including stripping the article from the pocket after the drum has rotated approximately 40 degrees.

38. An article receiver for receiving magnetically attractive cylindrically configured articles during a wrap around labeling process so as to retard rotation of the article and apply pressure onto a seam comprising an article receiving member having a concave surface with two opposing exposed edges to form an article receiving pocket, said concave surface being configured for receiving an article therein, and a plurality or, rotation retarding magnets positioned within said article receiving member for exerting an attractive biasing force on the article toward the pocket.

39. The article receiver according to claim 38 wherein said plurality of magnets comprises first and second rows which exert a biasing force normal to the formed article receiving pocket.

* * * * *

UNITED STATES PATENT AND TRADEMARK OFFICE

CERTIFICATE OF CORRECTION

PATENT NO. : 5,458,728
DATED : October 17, 1995
INVENTOR(S) : John Galchefski

It is certified that error appears in the above-indentified patent and that said Letters Patent is hereby corrected as shown below:

At Column 1, line 37, change "tile" to -- the --;
At Column 2, line 50, change "me, dial" to -- medial --;

Signed and Sealed this

Twenty-third Day of January, 1996

*Attest:*

Bruce Lehman

BRUCE LEHMAN

*Attesting Officer*

*Commissioner of Patents and Trademarks*